US009378877B2

(12) United States Patent
Fujita et al.

(10) Patent No.: US 9,378,877 B2
(45) Date of Patent: Jun. 28, 2016

(54) METHOD FOR MANUFACTURING CERAMIC ELECTRONIC COMPONENT

(71) Applicant: MURATA MANUFACTURING CO., LTD., Kyoto (JP)

(72) Inventors: Yuko Fujita, Kyoto (JP); Atsushi Yamamoto, Kyoto (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/161,590

(22) Filed: Jan. 22, 2014

(65) Prior Publication Data

US 2014/0252693 A1 Sep. 11, 2014

Related U.S. Application Data

(63) Continuation of application No. PCT/JP2012/069554, filed on Aug. 1, 2012.

(30) Foreign Application Priority Data

Aug. 5, 2011 (JP) ..... 2011-171804

(51) Int. Cl.
*H01F 1/01* (2006.01)
*H01F 41/04* (2006.01)
*H01F 17/00* (2006.01)

(52) U.S. Cl.
CPC ..... *H01F 1/01* (2013.01); *H01F 41/046* (2013.01); *H01F 17/0033* (2013.01)

(58) Field of Classification Search
CPC ..... H01F 41/046
See application file for complete search history.

(56) References Cited

U.S. PATENT DOCUMENTS 6,504,466 B1 * 1/2003 Katsurada ..... 336/200
8,531,260 B2 9/2013 Shiota et al.
8,590,123 B2 11/2013 Yamamoto et al.

(Continued)

FOREIGN PATENT DOCUMENTS

CN 1455937 A 11/2003
CN 1674176 A 9/2005

(Continued)

OTHER PUBLICATIONS

JP 2007-067219 (Okuda) Mar. 15, 2007 (English language machine translation of document cited on IDS dated Jan. 22, 2014). [online] [retrieved Jun. 11, 2015]. Retrieved from: Espacenet.*

(Continued)

*Primary Examiner* — Erin Snelting
(74) *Attorney, Agent, or Firm* — Studebaker & Brackett PC

(57) ABSTRACT

A ceramic electronic component which can achieve favorable electrical properties in such a way that the insulation property of a magnetic section can be ensured, and that the oxidation of Cu as an internal conductor is suppressed. A method for manufacturing ceramic electronic component has a feature that includes a firing step of firing at a predetermined temperature rising rate X (° C./min) and oxygen partial pressure Y (Pa), and when the temperature rising rate and the oxygen partial pressure are respectively indicated on an x axis and a Y axis, the firing is carried out under the condition indicated by the region surrounded by (X, Y)=A (50, 0.05), B (1000, 0.05), C (1000, 0.01), D (1500, 0.01), E (1500, 0.001), F (2000, 0.001), G (2000, 100), H (1500, 100), I (1500, 50), J (1000, 50), K (1000, 10), and L (50, 10).

3 Claims, 5 Drawing Sheets

(56) References Cited

U.S. PATENT DOCUMENTS

| | | | | |
|---|---|---|---|---|
| 2003/0136468 | A1 | 7/2003 | Kanekiyo et al. | |
| 2005/0213283 | A1 | 9/2005 | Nakano et al. | |
| 2011/0075318 | A1 | 3/2011 | Suzuki et al. | |
| 2011/0102124 | A1* | 5/2011 | Matsushita | 336/200 |
| 2011/0110014 | A1 | 5/2011 | Hirata et al. | |
| 2013/0140946 | A1 | 6/2013 | Banno et al. | |
| 2014/0078641 | A1 | 3/2014 | Hirata et al. | |

FOREIGN PATENT DOCUMENTS

| | | | |
|---|---|---|---|
| CN | 102034606 | A | 4/2011 |
| CN | 102099880 | A | 6/2011 |
| JP | 07-097525 | B2 | 10/1995 |
| JP | 2002-329604 | A | 11/2002 |
| JP | 2007-067219 | A | 3/2007 |
| WO | 2011/093489 | A1 | 8/2011 |
| WO | 2011-114805 | A1 | 9/2011 |
| WO | 2011/114809 | A1 | 9/2011 |

OTHER PUBLICATIONS

International Search Report; PCT/JP2012/069554; Nov. 6, 2012.
Written Opinion of the International Searching Authority; PCT/JP2012/069554; Nov. 6, 2012.
H.J.T.Ellingham; "Reducibility of Oxides and Sulphides in Metallurgical Processes"; Transactions and Communications; May 1944; pp. 125-133; Journal of the Society of Chemical Industry.

* cited by examiner

METHOD FOR MANUFACTURING CERAMIC ELECTRONIC COMPONENT

CROSS REFERENCE TO RELATED APPLICATIONS

This application claims benefit of priority to Japanese Patent Application No. 2011-171804 filed Aug. 5, 2011, and to International Patent Application No. PCT/JP2012/069554 filed on Aug. 1, 2012, the entire content of each of which is incorporated herein by reference.

TECHNICAL FIELD

The present technical field relates to a method for manufacturing a ceramic electronic component. More particularly, the present technical field relates to a method for manufacturing a ceramic electronic component including: a magnetic section containing at least Fe, Ni, and Zn; and an internal conductor containing Cu as its main constituent, which is buried in the magnetic section.

BACKGROUND

Conventionally, ceramic electronic components have been known which include a magnetic section, and an internal conductor buried in the magnetic section. The magnetic section and internal conductor are preferably subjected to co-firing in the interest of expediting the manufacturing process. Further, to save cost, the development of internal conductors containing Cu as their main constituent has been advanced. As such electronic components, copper conductor co-fired ferrite elements are known, for example, as in Japanese Patent Application Laid-Open No. 7-97525.

In this Japanese Patent Application Laid-Open No. 7-97525, the addition of low-melting-point glass components of PbO, $B_2O_3$, and $SiO_2$ to a Ni—Zn ferrite material allows firing at low temperatures of 950 to 1030° C. under a nitrogen atmosphere, and allows co-firing with Cu.

On the other hand, the Ellingham diagram shown in E. T. T. Ellingham: J. Soc. Chem. Ind., UK, vol. 63, p. 125, 1944 is known as indicating the equilibrium oxygen partial pressures for oxides. According to this Ellingham diagram, it is known that from the relationship between the equilibrium oxygen partial pressure of Cu—$Cu_2O$ and the equilibrium oxygen partial pressure of $Fe_2O_3$—$Fe_3O_4$, there is no region where Cu and $Fe_2O_3$ coexist at 800° C. or higher. More specifically, at temperatures of 800° C. or higher, when firing is carried out with the oxygen partial pressure set in such an atmosphere that maintains the state of $Fe_2O_3$, Cu is also oxidized to produce $Cu_2O$. On the other hand, when firing is carried out with the oxygen partial pressure set in an atmosphere that does not oxidize Cu, $Fe_2O_3$ is reduced to produce $Fe_3O_4$.

SUMMARY

Problem to be Solved by the Invention

As described above, Japanese Patent Application Laid-Open No. 7-97525 states that co-firing of Cu with a ferrite material can be achieved under a nitrogen atmosphere. However, according to E. T. T. Ellingham: J. Soc. Chem. Ind., UK, vol. 63, p. 125, 1944, there is no region where Cu and $Fe_2O_3$ coexist, and thus, firing in an atmosphere at an oxygen partial pressure that does not oxidize Cu reduces $Fe_2O_3$ to $Fe_3O_4$, thus decreasing the resistivity ρ, and possibly leading to degradation of electrical properties.

Moreover, in the case of Patent Document 1, because of the addition of PbO, $B_2O_3$, and $SiO_2$ as glass components, these glass components cause abnormal grain growth during the firing to lead to a decrease in magnetic permeability, etc., and it is thus difficult to achieve desirable favorable magnetic properties. In addition, the ferrite in Japanese Patent Application Laid-Open No. 7-97525 is also problematic from the viewpoint of an environment load, because PbO is contained in the ferrite.

The present disclosure has been achieved in view of these circumstances, and an object of the present disclosure is to provide a ceramic electronic component which can achieve favorable electrical properties, in such a way that the insulation property of a magnetic section can be ensured, and that the oxidation of Cu as an internal conductor is suppressed, even when the internal conductor containing Cu as its main constituent and the magnetic section are subjected to co-firing.

Means for Solving the Problem

A method for manufacturing a ceramic electronic component according to the present disclosure is a method for manufacturing a ceramic electronic component including: a magnetic section containing at least Fe, Ni, and Zn; and an internal conductor containing Cu as its main constituent, which is buried in the magnetic section, the method has a feature that it comprises a firing step of firing an unfired laminated body which has an internal conductor material to serve as the internal conductor after the firing, buried in a magnetic material to serve as the magnetic section after the firing, at a predetermined temperature rising rate X (° C./min) and an oxygen partial pressure Y (Pa), and when the temperature rising rate X and the oxygen partial pressure Y are respectively indicated on an x axis and a Y axis, the firing is carried out under the condition indicated by the region surrounded by (X, Y)=A (50, 0.05), B (1000, 0.05), C (1000, 0.01), D (1500, 0.01), E (1500, 0.001), F (2000, 0.001), G (2000, 100), H (1500, 100), I (1500, 50), J (1000, 50), K (1000, 10), and L (50, 10).

In addition, in the method for manufacturing a ceramic electronic component according to the present disclosure, the firing is preferably carried out under the condition indicated by the region surrounded by (X, Y)=A' (50, 1), B' (1000, 1), C' (1000, 0.1), D' (1500, 0.1), E' (1500, 0.05), F' (2000, 0.05), G (2000, 100), H (1500, 100), I (1500, 50), J (1000, 50), K (1000, 10), and L (50, 10).

Effect of the Invention

Under the firing condition according to the present disclosure, the firing is completed before Cu is oxidized, and before the magnetic section is reduced to decrease the resistivity. Therefore, a ceramic electronic component can be achieved in which a magnetic section is high in insulation resistance, and an internal conductor is low in direct-current resistance.

DETAILED DESCRIPTION

An embodiment for carrying out the present disclosure will be described below.

Figure 1:
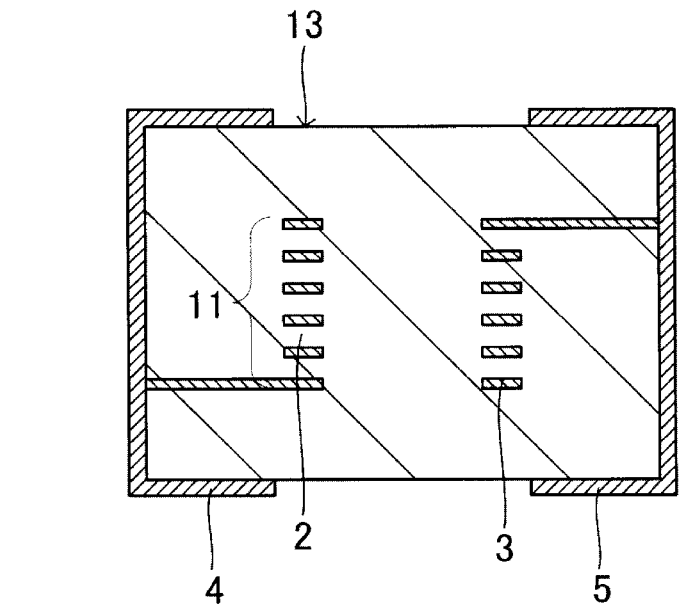
FIG. 1 is a cross-sectional view of a ceramic electronic component.

First of all, a ceramic electronic component will be described. FIG. 1 is a cross-sectional view of the ceramic electronic component. This ceramic electronic component 1 includes a laminated body 13 and external electrodes 4 and 5.

The laminated body 13 includes a magnetic section 2 and an internal conductor 3 buried in the magnetic section 2. It is to be noted that the internal conductor 3 in FIG. 1 is shown schematically for understanding.

The magnetic section 2 has ferrite containing at least Fe, Ni, and Zn, and may contain Cu. The contents of Fe, Zn, Cu, and Ni in the magnetic section 2 are not to be considered particularly limited, but preferably blended so as to be respectively 40 to 49.5 mol % in terms of $Fe_2O_3$, 5 to 35 mol % in terms of ZnO, 0 to 12 mol % in terms of CuO, and the balance in terms of NiO.

When $Fe_2O_3$ is 40 mol % or more, the magnetic permeability reaches a sufficiently high range. In addition, when $Fe_2O_3$ is 49.5 mol % or less, a denser sintered body is achieved. When ZnO is 5 mol % or more, the magnetic permeability reaches a sufficiently high range. In addition, when ZnO is 35 mol % or less, the Curie point is further improved. When CuO is 12 mol % or less, the amount of CuO is reduced which is left as a different phase after the firing.

The internal conductor 3 contains Cu as its main constituent. In addition, the internal conductor 3 forms a spiral coil 11.

The external electrodes 4, 5 are formed on both end surfaces of the laminated body 13. In addition, the external electrodes 4, 5 are electrically connected to both ends of the spiral coil 11. Examples of the material for the external electrodes 4, 5 include Ag.

Next, a method for manufacturing the ceramic electronic component will be described with reference to FIGS. 2 to 4.

First of all, $Fe_2O_3$, ZnO, CuO, and NiO are prepared as ceramic raw materials. Then, these ceramic raw materials are weighed so as to provide predetermined composition ratios.

Next, the weighed materials are put in a pot mill along with pure water and balls such as PSZ (partially stabilized zirconia) balls, and subjected to adequate mixing and grinding. Thereafter, the mixture is dried. Then, the dried mixture is subjected to calcination for a given period of time at a temperature of 600 to 800° C.

Next, the calcined product is put again into a pot mill along with a binder such as polyvinyl butyral, a solvent such as ethanol or toluene, and PSZ balls, and subjected to adequate mixing to prepare a ceramic slurry.

Figure 2A:
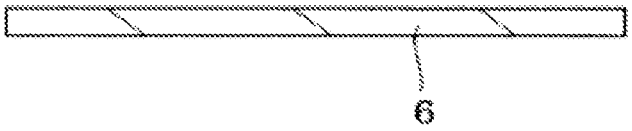
FIGS. 2A, 2B, and 2C show cross-sectional views illustrating a method for manufacturing a ceramic electronic component according to the present disclosure.

Next, as in FIG. 2A, a doctor blade method or the like is used to form the ceramic slurry into the shape of a sheet, thereby forming a ceramic green sheet 6 with a predetermined film thickness.

Figure 2B:
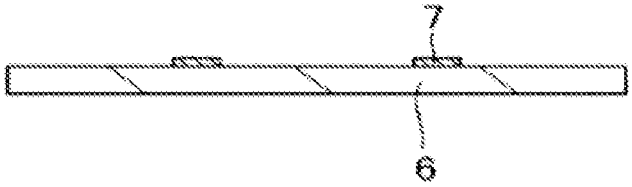

Next, as in FIG. 2B, a conductor pattern 7 is formed on the ceramic green sheet 6. Specifically, a conductive paste is prepared which contains Cu as its main constituent. Then, a conductor pattern 7 is formed in such a way that the conductive paste is applied by a screen printing method onto the surface of the ceramic green sheet 6.

Figure 2C:
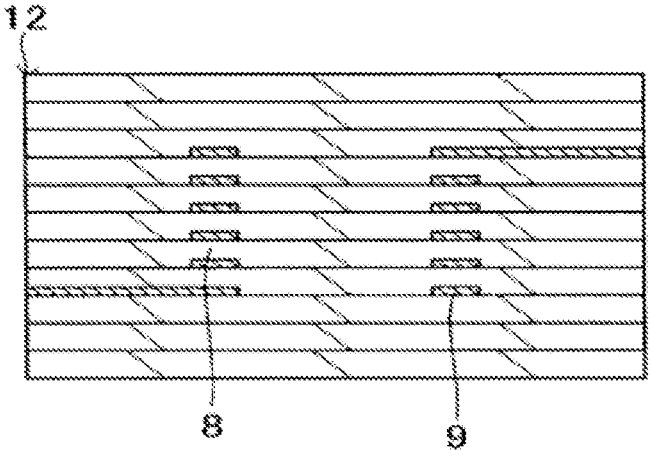

Next, as in FIG. 2C, multiple ceramic green sheets are stacked to form an unfired laminated body 12. In this case, through the stacking, the conductor patterns serve as an internal conductor material 9, whereas the ceramic green sheets serve as a magnetic material 8. Further, the internal conductor material 9 is buried in the magnetic material 8.

Figure 3A:
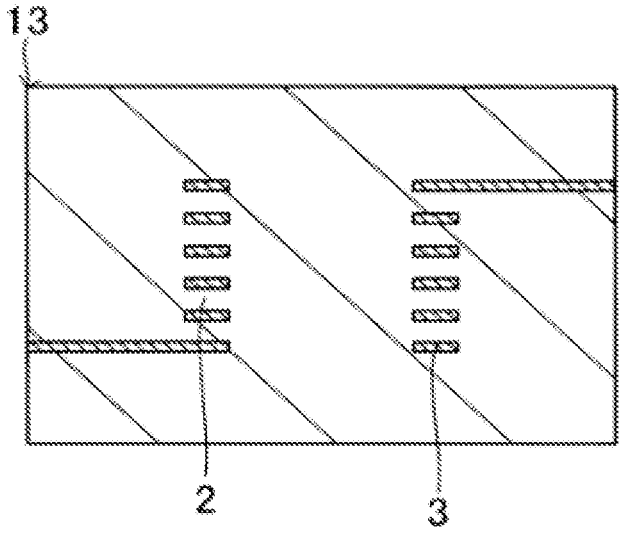
FIGS. 3A and 3B show cross-sectional views illustrating the method for manufacturing a ceramic electronic component according to the present disclosure, subsequent to FIG. 2.

Next, as in FIG. 3A, the unfired laminated body is subjected to firing to form a laminated body 13.

In the present embodiment, the unfired laminated body is subjected to firing at a predetermined temperature rising rate X (° C./min) and a predetermined oxygen partial pressure Y (Pa). FIG. 4 is a diagram indicating the range of the firing condition, with the temperature rising rate X (° C./min) on the x axis and the oxygen partial pressure Y (Pa) on the y axis. The present embodiment has a feature that firing is carried out under the condition indicated by the region surrounded by (X, Y)=A (50, 0.05), B (1000, 0.05), C (1000, 0.01), D (1500, 0.01), E (1500, 0.001), F (2000, 0.001), G (2000, 100), H (1500, 100), I (1500, 50), J (1000, 50), K (1000, 10), and L (50, 10) as in FIG. 4.

As described previously, from the relationship between the equilibrium oxygen partial pressure of Cu—$Cu_2O$ and the equilibrium oxygen partial pressure of $Fe_2O_3$—$Fe_3O_4$, there is no region where Cu and $Fe_2O_3$ coexist at high temperatures of 800° C. or higher. Therefore, when firing is carried out under a normal firing condition, a problem is created which is oxidation of Cu as the main constituent of the internal conductor 3, or reduction of Fe in the magnetic section 2, resulting in a decrease in resistivity.

Under the firing condition according to the present disclosure, however, the firing is completed before Cu is oxidized, and before Fe in the magnetic section 2 is reduced to decrease the resistivity. Therefore, a ceramic electronic component can be achieved in which the magnetic section 2 is high in insulation resistance, and the internal conductor 3 is low in direct-current resistance.

In this specification, the temperature rising rate denotes the average value obtained in such a way that the value obtained by subtracting the heating start temperature from the maximum temperature during the firing is divided by the heating time. In addition, the oxygen partial pressure denotes the average value for the oxygen partial pressure during the firing.

Figure 5:
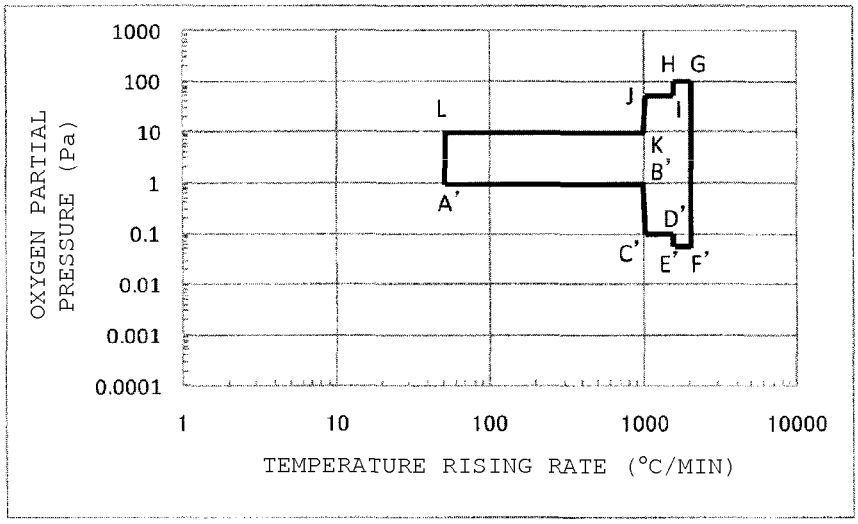
FIG. 5 is a diagram indicating the range of a more preferred firing condition according to the present disclosure, with the temperature rising rate X (° C./min) on the x axis and the oxygen partial pressure Y (Pa) on the y axis.

FIG. 5 shows a further preferred firing condition according to the present embodiment. FIG. 5 is a diagram indicating the range of the firing condition, with the temperature rising rate X (° C./min) on the x axis and the oxygen partial pressure Y (Pa) on the y axis. In the present embodiment, as in FIG. 5, the firing is preferably carried out under the condition indicated by the region surrounded by (X, Y)=A' (50, 1), B' (1000, 1), C' (1000, 0.1), D' (1500, 0.1), E' (1500, 0.05), F' (2000, 0.05), G (2000, 100), H (1500, 100), I (1500, 50), J (1000, 50), K (1000, 10), and L (50, 10). This case has the effect of further improved resistivity.

Figure 3B:
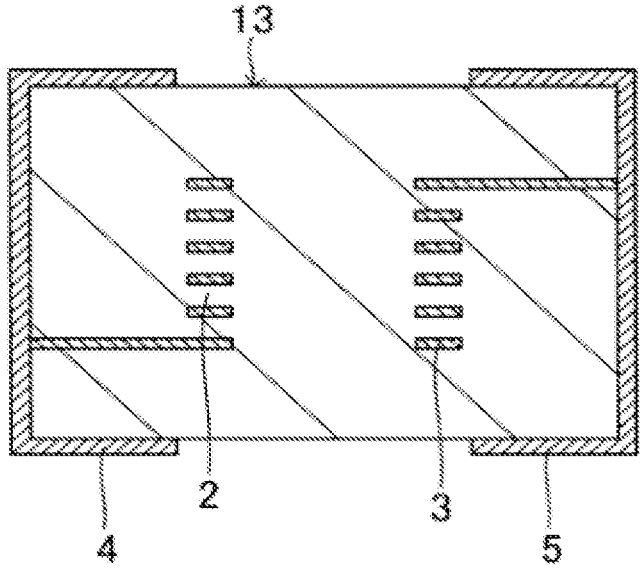

Next, as in FIG. 3B, the external electrodes 4, 5 are formed on end surfaces of the laminated body 13. The electrodes 4, 5 are formed, for example, in such a way that a conductive paste is applied, dried, and then baked at 750° C. to 800° C. Plating films of Ni and Sn may be further provided on the surfaces of the external electrodes 4, 5. In this case, the wettability to solder for mounting is improved.

Next, an experimental example of the present disclosure will be specifically described.

Experimental Example 1

$Fe_2O_3$, ZnO, NiO, and CuO were prepared as ceramic raw materials. Then, these ceramic raw materials were weighed for proportions of $Fe_2O_3$: 48.5 mol %, ZnO: 30.0 mol %, NiO: 20.5 mol %, and CuO: 1.0 mol %. Thereafter, these weighed materials were put in a pot mill made of vinyl chloride along with pure water and PSZ balls, subjected to mixing and grinding for 48 hours in a wet way and to evaporative drying, and then subjected to calcination at a temperature of 750° C.

Next, the calcined products were put again in a pot mill made of vinyl chloride along with ethanol and PSZ balls, subjected to mixing and grinding for 48 hours, and then mixed for 8 hours after the addition of a polyvinyl butyral based binder to obtain a ceramic slurry.

Next, a doctor blade method was used to form the ceramic slurry into the shape of a sheet to have a thickness of 35 μm, and this sheet was subjected to punching into a size of 50 mm×50 mm to prepare ceramic green sheets.

Next, a laser processing machine was used to form via holes in predetermined positions of the ceramic green sheets. Thereafter, a Cu paste containing a Cu powder, varnish, and an organic solvent was applied by screen printing onto the surfaces of the ceramic green sheets. At the same time, the via holes were filled with the Cu paste. Thus, the conductor patterns in predetermined shapes and the via hole conductors were formed.

Next, the ceramic green sheets with the conductor patterns formed were stacked. Thereafter, these sheets were sandwiched between ceramic green sheets with no conductor patterns formed. Then, the sheets were subjected to pressure bonding under the condition at 60° C. and 100 MPa to prepare a pressure-bonded block. Then, this pressure-bonded block was cut into a predetermined size to prepare an unfired laminated body.

Next, this unfired laminated body was subjected to adequate degreasing by heating to 500 to 600° C. in an atmosphere that does not oxidize Cu. Thereafter, a laminated body with an internal conductor buried in a magnetic section was prepared by carrying out firing under the condition shown in Table 1 with a temperature rising rate from 25 to 2000° C./min while controlling the oxygen partial pressure to 0.0001 to 500 Pa with a mixed gas of $N_2$—$H_2$—$H_2O$. The maximum temperature of the firing temperature was measured with a thermocouple placed near the sample. Then, the temperature started to be decreased when the maximum temperature reached a predetermined temperature.

Next, a conductive paste for external electrodes was prepared containing an Ag powder, glass frit, varnish, and an organic solvent. Then, this conductive paste for external electrodes was applied onto both ends of the laminated body, and dried. Thereafter, the conductive paste was baked at 750° C. to form external electrodes. In this way, samples (sample numbers 1-1 to 11-7) listed in Table 1 were prepared. It is to be noted that the external dimensions of each sample were 1.6 mm in length, 0.8 mm in width, and 0.8 mm in thickness, and the number of turns in a coil was 9.5. In addition, the mark * in the table refers to outside the scope of the present disclosure.

TABLE 1

| Oxygen Partial Pressure (Pa) | Temperature Rising Rate (° C./min) 25 | 50 | 100 | 500 | 1000 | 1500 | 2000 |
|---|---|---|---|---|---|---|---|
| 500 | *1-1 | *1-2 | *1-3 | *1-4 | *1-5 | *1-6 | *1-7 |
| 100 | *2-1 | *2-2 | *2-3 | *2-4 | *2-5 | 2-6 | 2-7 |
| 50 | *3-1 | *3-2 | *3-3 | *3-4 | 3-5 | 3-6 | 3-7 |
| 10 | *4-1 | 4-2 | 4-3 | 4-4 | 4-5 | 4-6 | 4-7 |
| 5 | *5-1 | 5-2 | 5-3 | 5-4 | 5-5 | 5-6 | 5-7 |
| 1 | *6-1 | 6-2 | 6-3 | 6-4 | 6-5 | 6-6 | 6-7 |
| 0.1 | *7-1 | 7-2 | 7-3 | 7-4 | 7-5 | 7-6 | 7-7 |
| 0.05 | *8-1 | 8-2 | 8-3 | 8-4 | 8-5 | 8-6 | 8-7 |
| 0.01 | *9-1 | *9-2 | *9-3 | *9-4 | 9-5 | 9-6 | 9-7 |
| 0.001 | *10-1 | *10-2 | *10-3 | *10-4 | *10-5 | 10-6 | 10-7 |
| 0.0001 | *11-1 | *11-2 | *11-3 | *11-4 | *11-5 | *11-6 | *11-7 |

For 20 of the samples obtained, the resistance across the external electrodes was measured with a milliohm meter to obtain the direct-current resistance Rdc (Ω) of the internal conductor.

Furthermore, samples were formed for measuring the insulation resistance of the magnetic section. Specifically, ceramic green sheets with no conductor pattern or via hole conductor formed were staked for a predetermined number of ceramic green sheets, and subjected to the same cutting and firing as described above. Then, samples were prepared which were 1.6 mm in length, 0.8 mm in width, and 0.8 mm in thickness. Then, an indium-gallium alloy was applied onto both principal surfaces of the ferrite body.

For 20 of the obtained samples for insulation resistance measurement, 50 V was applied to measure the insulation resistance, and the resistivity ρ (Ω-cm) was obtained from the sample shape.

Table 2 shows results for the direct-current resistance Rdc (Ω) of the internal conductor. In addition, Table 3 shows results for the resistivity log ρ (Ω-cm) of the magnetic section.

TABLE 2

| Oxygen Partial Pressure (Pa) | Temperature Rising Rate (° C./min) 25 | 50 | 100 | 500 | 1000 | 1500 | 2000 |
|---|---|---|---|---|---|---|---|
| 500 | — | — | — | 92 | 55 | 2.2 | 1.9 |
| 100 | — | 170 | 53 | 3.5 | 2.2 | 0.20 | 0.20 |
| 50 | — | 1.0 | 0.80 | 0.39 | 0.20 | 0.19 | 0.18 |
| 10 | — | 0.20 | 0.20 | 0.19 | 0.19 | 0.18 | 0.17 |
| 5 | — | 0.18 | 0.18 | 0.19 | 0.18 | 0.16 | 0.15 |
| 1 | 150 | 0.17 | 0.17 | 0.16 | 0.16 | 0.16 | 0.15 |
| 0.1 | 0.2 | 0.16 | 0.16 | 0.15 | 0.15 | 0.14 | 0.14 |
| 0.05 | 0.16 | 0.14 | 0.14 | 0.14 | 0.14 | 0.14 | 0.14 |
| 0.01 | 0.14 | 0.14 | 0.14 | 0.14 | 0.13 | 0.13 | 0.13 |
| 0.001 | 0.14 | 0.14 | 0.14 | 0.14 | 0.13 | 0.13 | 0.13 |
| 0.0001 | 0.14 | 0.14 | 0.14 | 0.13 | 0.13 | 0.13 | 0.13 |

TABLE 3

| Oxygen Partial Pressure | Temperature Rising Rate (° C./min) | | | | | | |
|---|---|---|---|---|---|---|---|
| (Pa) | 25 | 50 | 100 | 500 | 1000 | 1500 | 2000 |
| 500 | 9.0 | 9.0 | 9.0 | 9.0 | 9.0 | 9.0 | 9.0 |
| 100 | 9.0 | 9.0 | 9.0 | 9.0 | 9.0 | 9.0 | 9.0 |
| 50 | 9.0 | 9.0 | 9.0 | 9.0 | 8.8 | 8.7 | 8.5 |
| 10 | 8.8 | 8.8 | 8.8 | 8.7 | 8.5 | 8.2 | 7.9 |
| 5 | 8.5 | 8.5 | 8.5 | 8.4 | 8.1 | 7.9 | 7.6 |
| 1 | 7.8 | 7.8 | 7.8 | 7.8 | 7.6 | 7.4 | 7.4 |
| 0.1 | 4.8 | 5.6 | 5.8 | 6.0 | 7.1 | 7.2 | 7.3 |
| 0.05 | 4.2 | 5.1 | 5.3 | 5.7 | 6.8 | 7.0 | 7.2 |
| 0.01 | 3.4 | 4.1 | 4.4 | 4.8 | 5.8 | 6.2 | 6.5 |
| 0.001 | 3.0 | 3.6 | 3.9 | 4.1 | 4.8 | 5.2 | 5.5 |
| 0.0001 | 2.5 | 3.2 | 3.3 | 3.4 | 3.8 | 4.0 | 4.2 |

Figure 4:
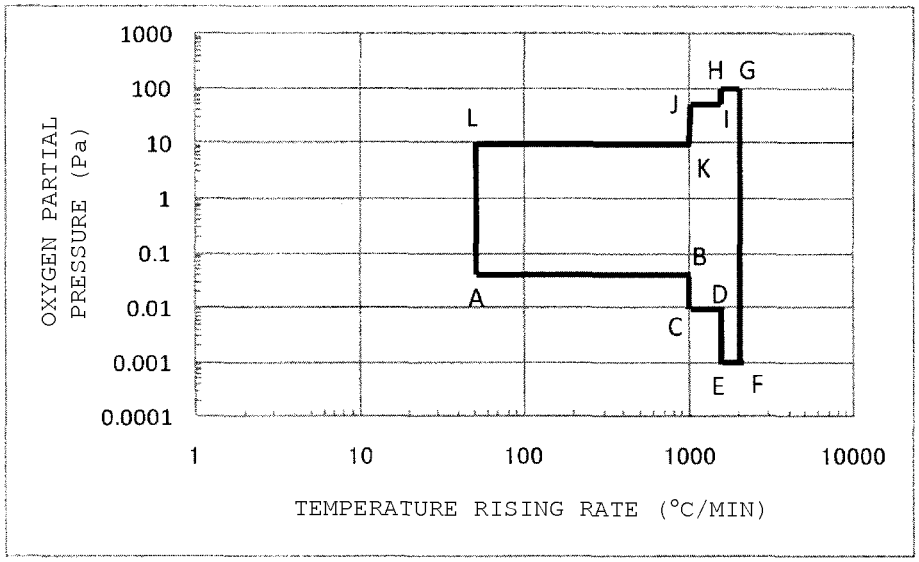
FIG. 4 is a diagram indicating the range of a firing condition according to the present disclosure, with the temperature rising rate X (° C./min) on the x axis and the oxygen partial pressure Y (Pa) on the y axis.

From the results in Tables 2 and 3, in the case of firing under the condition indicated by the region surrounded by (X, Y)=A (50, 0.05), B (1000, 0.05), C (1000, 0.01), D (1500, 0.01), E (1500, 0.001), F (2000, 0.001), G (2000, 100), H (1500, 100), I (1500, 50), J (1000, 50), K (1000, 10), L (50, 10) in FIG. 4, the internal conductor has a small direct-current resistance of 0.2Ω or less. In addition, the magnetic section has a high insulation resistance of 5 or more in terms of resistivity of log ρ, and a ceramic electronic component with favorable characteristics can be thus achieved.

Furthermore, in the case of firing under the condition indicated by the region surrounded by (X, Y)=A' (50, 1), B' (1000, 1), C' (1000, 0.1), D' (1500, 0.1), E' (1500, 0.05), F' (2000, 0.05), G (2000, 100), H (1500, 100), I (1500, 50), J (1000, 50), K (1000, 10), and L (50, 10) in FIG. 5, the magnetic section has a higher insulation resistance of 7 or more in terms of resistivity of log ρ, and a ceramic electronic component with further favorable characteristics can be thus achieved.

Figure 6:
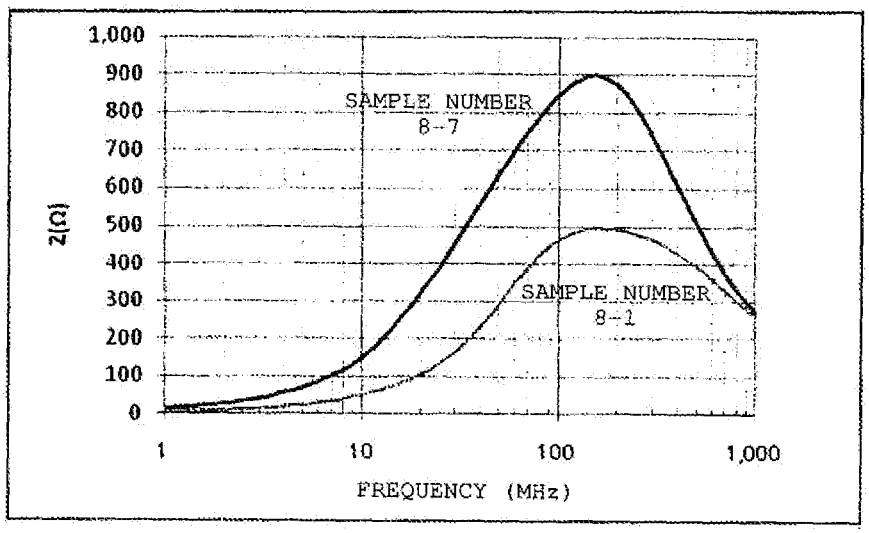
FIG. 6 is a diagram showing impedance frequency characteristics of sample number 8-1 and sample number 8-7.

Next, for sample number 8-7 (oxygen partial pressure: 0.05 Pa, temperature rising rate: 2000° C./min) and sample number 8-1 (oxygen partial pressure: 0.05 Pa, temperature rising rate: 25° C./min), an impedance analyzer (Model Number: HP4291A) from Agilent Technologies was used to measure the impedance frequency characteristics. The results are shown in FIG. 6.

The sample numbers 8-1 and 8-7 both have peaks around 160 MHz, while the sample number 8-1 has a lower impedance value of approximately 500Ω. This is believed that the $Fe_2O_3$ contained in the magnetic section was partially reduced to $Fe_3O_4$ in the firing step.

It is to be noted that the present embodiment is not to be considered limited to the embodiment described above, but various changes can be made thereto without departing from the scope of the disclosure.

The invention claimed is:

1. A method for manufacturing a ceramic electronic component having a magnetic section containing at least Fe, Ni, and Zn and an internal conductor containing Cu as a main constituent, the internal conductor being buried in the magnetic section, the method comprising the steps of firing an unfired laminated body having an internal conductor material to serve as the internal conductor after the firing, the internal conductor material being buried in a magnetic material to serve as the magnetic section after the firing, the firing being at a predetermined temperature rising rate X (° C./min) and oxygen partial pressure Y (Pa), and when the temperature rising rate and the oxygen partial pressure are respectively indicated on an x axis and a Y axis, the firing being carried out under a maximum condition indicated by a region surrounded by (X, Y)=A (50, 0.05), B (1000, 0.05), C (1000, 0.01), D (1500, 0.01), E (1500, 0.001), F (2000, 0.001), G (2000, 100), H (1500, 100), I (1500, 50), J (1000, 50), K (1000, 10), and L (50, 10).

2. The method for manufacturing a ceramic electronic component according to claim 1, wherein the firing is carried out under a condition indicated by a region surrounded by (X, Y)=A' (50, 1), B' (1000, 1), C' (1000, 0.1), D' (1500, 0.1), E' (1500, 0.05), F' (2000, 0.05), G (2000, 100), H (1500, 100), I (1500, 50), J (1000, 50), K (1000, 10), and L (50, 10).

3. The method for manufacturing a ceramic electronic component according to claim 1, wherein the magnetic section includes 40 to 49.5 mol % $Fe_2O_5$, 5 to 30 mol % ZnO, 0 to 12 mol % CuO and a balance of NiO.

* * * * *